US005707031A

United States Patent [19]

Creighton-Young

[11] Patent Number: 5,707,031

[45] Date of Patent: Jan. 13, 1998

[54] ARM SUPPORT

[75] Inventor: Taryn Creighton-Young, 2 Cleaveholm Drive, Georgetown, Ontario, Canada, L7G 3E1

[73] Assignee: Taryn Creighton-Young, Georgetown, Canada

[21] Appl. No.: 589,676

[22] Filed: Jan. 22, 1996

[30] Foreign Application Priority Data

Jan. 26, 1995 [CA] Canada ..... 2141155

[51] Int. Cl.[6] ..... B68G 5/00

[52] U.S. Cl. ..... 248/118; 248/102

[58] Field of Search ..... 248/118, 118.1, 248/118.3, 118.5, 104, 102

[56] References Cited

U.S. PATENT DOCUMENTS

| | | | |
|---|---|---|---|
| 226,411 | 4/1880 | McElroy . | |
| 1,617,944 | 2/1927 | Gerstner | 248/102 |
| 2,134,746 | 10/1938 | Allen | 248/102 |
| 5,183,229 | 2/1993 | Duggan | 248/102 |
| 5,335,888 | 8/1994 | Thomsen | 248/118.5 |

FOREIGN PATENT DOCUMENTS

| | | |
|---|---|---|
| 637337 | 2/1962 | Canada . |
| 111916 | 7/1968 | United Kingdom . |

*Primary Examiner*—Ramon O. Ramirez
*Attorney, Agent, or Firm*—Peter R. Hammond

[57] ABSTRACT

A forearm supporting device that is particularly useful for persons nursing a baby comprises an inner, elongate body made of rigid material and having first and second ends. This body is tapered from the first to the second end. An outer sleeve of flexible sheet material extends completely around and along this elongate body and covers its top and bottom surfaces. One or two straps are provided to detachably connect the device to one's forearm. Preferably the body is made of rigid, insulating foam and is hollow so that it can be used to store a nursing bottle. An access opening into the body is provided at the first end.

20 Claims, 3 Drawing Sheets

ARM SUPPORT

This invention relates to devices for supporting a person's arm, particularly a person's forearm.

When breastfeeding or bottle feeding a baby it is necessary for the caregiver to support the baby with her or his arm in a manner where the baby's body extends at a slight angle to the horizontal plane, with the baby's head raised slightly. But often the baby must be held in the required manner for a considerable length of time and, unless the caregiver's arm is properly supported, supporting the baby in this manner can be very tiring. Often the caregiver will look for some supporting device that is readily available in the house to provide the required arm support.

Currently, most doctors, chiropractors and books recommend that a pillow be used to support the arm that is supporting a baby while the baby is feeding. A down pillow is too soft, and loses its shape easily. A contoured foam pillow provides adequate support, but is large and awkward. In addition, this type of foam pillow is designed for sleeping on in a bedroom, and is not aesthetically pleasing in the living room, which is where one most often feeds a baby. A smaller "throw cushion" may look fine in the living room and provide adequate support, but will be ruined when the baby spits up on it. While a washable cover would solve this problem, a pillow is generally bulky and awkward to travel with, and, if it fits inside a standard diaper bag at all, would leave no room for anything else.

A rocking chair is a common place to feed a baby, since the arms of the chair support the caregiver's arms. However, most rockers have wooden arms which are not very comfortable to lean on for any period of time. Many rocking chairs are also made to match the nursery furniture, and except for night or early morning feeds, one does not normally feed a baby in the nursery. Rocking chairs are not easily portable, and certainly cannot be taken on outings with the baby.

It is an object of the present invention to provide a forearm supporting device that is simple in its construction and relatively inexpensive to make and yet it can provide an ideal support for a woman or man who is feeding a baby. A preferred version of the supporting device is tapered from one end to the other so that the overall height of the device becomes less between its two ends. This way the device can easily be used by a caregiver to support a baby at the appropriate angle for breastfeeding or bottle feeding.

According to one aspect, it is a further object of the invention to provide a forearm supporting device that can be connected to one's forearm for ease of use and yet is comfortable when being used during the nursing or bottle-feeding of a baby.

SUMMARY OF THE INVENTION

According to one aspect of the invention, a forearm supporting device for use by a person comprises an inner elongate body made of substantially rigid material and having a top surface formed of this material and a bottom surface spaced from the top surface. This body is tapered from a first to a second end thereof so that the overall height of the device becomes less between the two ends. An outer sleeve of flexible sheet material extends completely around and along the elongate body. This sleeve covers the top and bottom surfaces of this body and is located adjacent thereto. There are also means for detachably connecting the device to a person's forearm.

The preferred outer sleeve substantially encloses the elongate body and is made of a soft, washable fabric.

According to another aspect of the invention, a forearm supporting device for use by a person comprises an elongate body having first and second ends and tapering from the first to the second end so that the overall height of the device becomes less between these ends. The body is made primarily of heat insulating material and has a cavity formed centrally therein. This cavity is sized to accommodate a nursing bottle and is surrounded by the insulating material.

There is an access opening in the first end of the body to permit the bottle to be inserted in the cavity. There are also means for detachably connecting the device to a person's forearm.

In the preferred device, the elongate body includes an inner core made of heat insulating plastic material and there is an outer fabric sleeve extending around and along this inner core.

According to a further aspect of the invention, a forearm supporting device for use by a person comprises an elongate body having first and second ends, a top surface and a bottom surface, a core of supporting material, and an outer sleeve of flexible sheet material covering this core. There are also means for detachably connecting the body to a person's forearm and means for adjusting the overall height of the device in a direction generally perpendicular to the top and bottom surfaces.

Preferably the height adjusting means is at least one flexible strap connected at one end to the elongate body.

Further features and advantages will become apparent from the following detailed description taken in conjunction with the accompanying drawings.

DETAILED DESCRIPTION OF PREFERRED EMBODIMENTS

Figure 1:
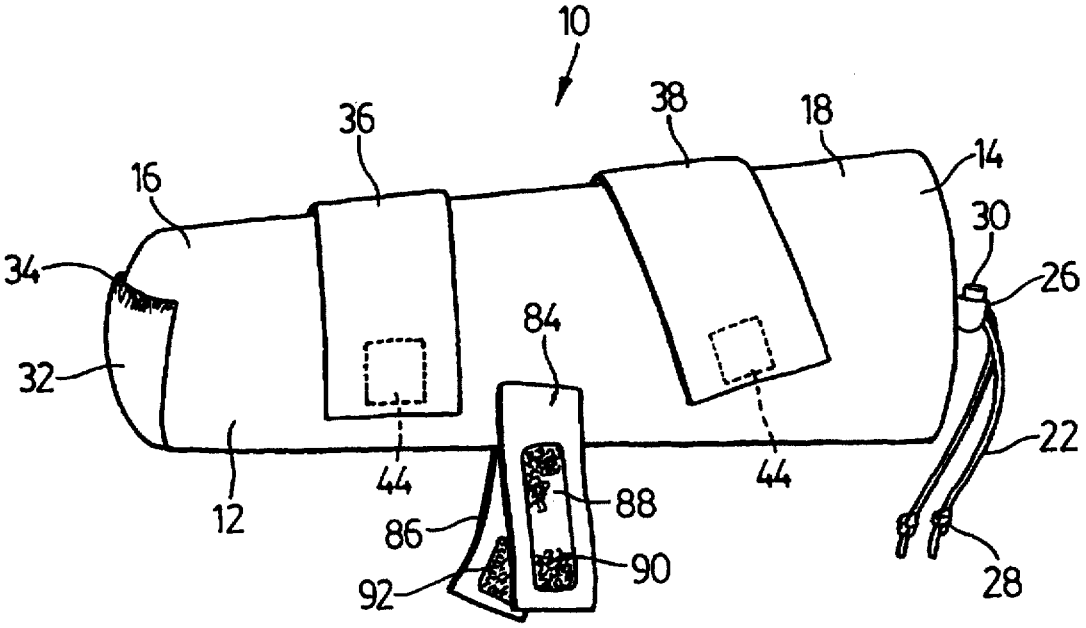
FIG. 1 is a side elevation of a foam supporting device constructed in accordance with the invention.
Figure 2:
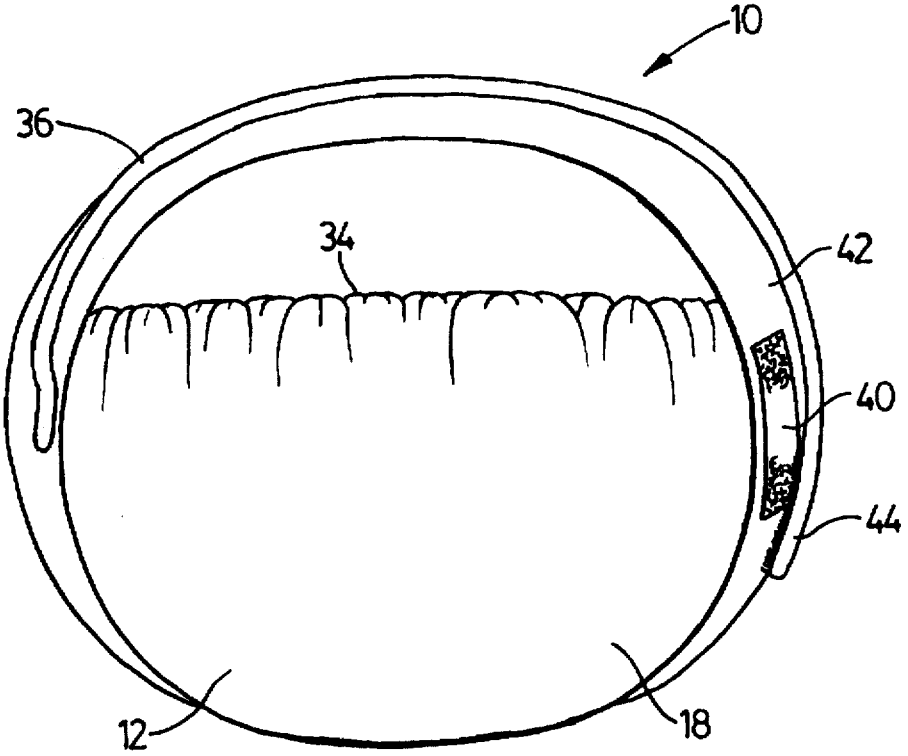
FIG. 2 is an end elevation of the supporting device taken from the left side of FIG. 1.
Figure 3:
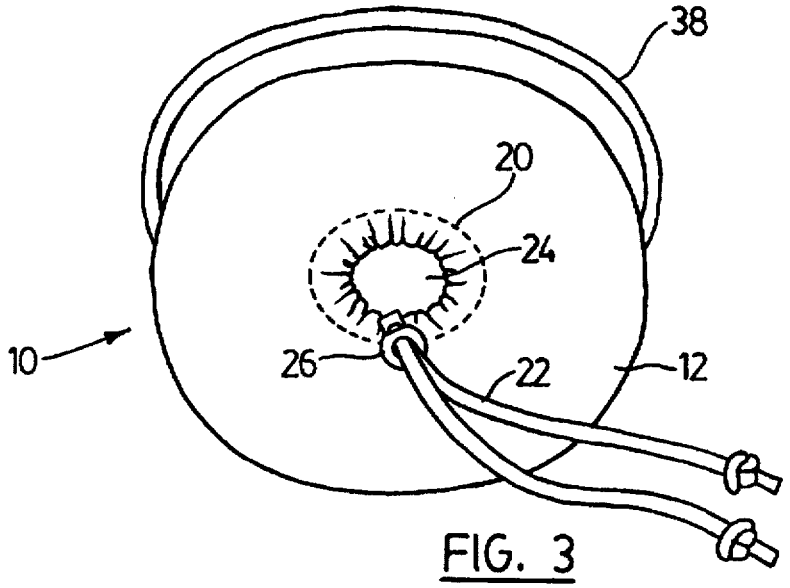
FIG. 3 is an end elevation of the supporting device, shown in a smaller scale than that of FIG. 2, taken from the right side of FIG. 1.

FIGS. 1 to 4 illustrate the exterior of a preferred form of forearm supporting device constructed in accordance with the invention. This device 10 is particularly useful for a person or caregiver who must support a baby while it is being breastfed or bottle fed. Such a person must try to support the baby's body so that it extends generally horizontally but with the baby's head raised slightly. The supporting device 10 includes an elongate body 12 having a first end 14 and a second end 16. The body tapers from the first end to the second end so that the overall height of the device becomes less between the first and second ends. Located on the exterior of the body is an outer sleeve 18 of flexible sheet material. The sleeve 18 extends completely around and along the elongate body 12. In the illustrated preferred embodiment, the sleeve substantially encloses the elongate body and is made of a soft, washable fabric such as cotton flannel. Preferably the sleeve is open at the wider, first end 14 so that the sleeve can be removed from the rest of the supporting device for cleaning or replacement purposes. The flannel material is folded inwardly at the open end and stitched at 20 to form a string or cord receiving end channel through which extends a cord or string 22. In a known manner, by pulling on the two projecting ends of the cord 22, the open end of the sleeve can be drawn closed, leaving only a small opening at 24. The cord or drawstring can be secured in the drawn out position by means of a known "toggle" device 26. The ends of the cord are preferably knotted as indicated at 28 so that the toggle 26 with its push button 30 cannot be removed. The drawstring should be used to keep the open end of the sleeve closed except when using an interior bottle cavity (described hereinafter) or when removing the sleeve 18 for washing.

The preferred device 10 comes with an elasticized pouch pocket 32 located at the second end 16. It is located so that it can be easily reached by a caregiver using her or his free hand without needing to reposition the baby. It can be used to hold such things as tissues, nursing pads, a pacifier or teething gel. It could also hold a "wet wipe" in a baggie and a small tube of petroleum jelly, for quick change on a short outing. It will be understood that an elastic band (not shown) is stretched along an upper edge 34 of this pocket.

The device 10 is provided with means for detachably connecting it to a person's forearm. The preferred connecting means comprises at least one or two connecting straps 36 and 38, each connected at one end to the fabric sleeve 18. When two straps are used, the strap 36 can be extended around a user's wrist while the other strap 38 is extended around the forearm below the user's elbow. The straps can be made of cotton flannel, the same material as the sleeve. The or each strap can be connected to the sleeve by means of suitable stitching, preferably at least a double stitch. The other end of the strap can be detachably connected to the exterior of the body by means of multiple hook and loop fastener means, one strip of which is stitched to the strap end while the opposite strip is stitched to the exterior of sleeve 18. One form of such fastener means is sold under the trade mark Velcro. If a single strap is used, it can be made quite wide to provide a firm, comfortable connection.

In the illustrated preferred embodiment, loop strips 40 are arranged on the sleeve 18 on a rounded side 42 thereof while hook strips 44 are arranged on the ends of the two straps. The straps are long enough so that the device 10 can be properly secured to the majority of both male and female arms. Moreover, once the straps 36 and 38 are adjusted to fit an individual, there is no need to detach the straps and to readjust them each time the supporting device 10 is used. A user's arms can be slid into and out of the two straps from the back (that is, from the wide end 14 of the device) and this also makes switching the device 10 from one arm to the other very simple. If the strips are initially adjusted so that they are loose enough that the arm can turn freely under them, then it is possible to flip the device 10 (by turning one's arm) so that a baby can be burped and put down to sleep without having to remove the device 10 first.

Figure 7:
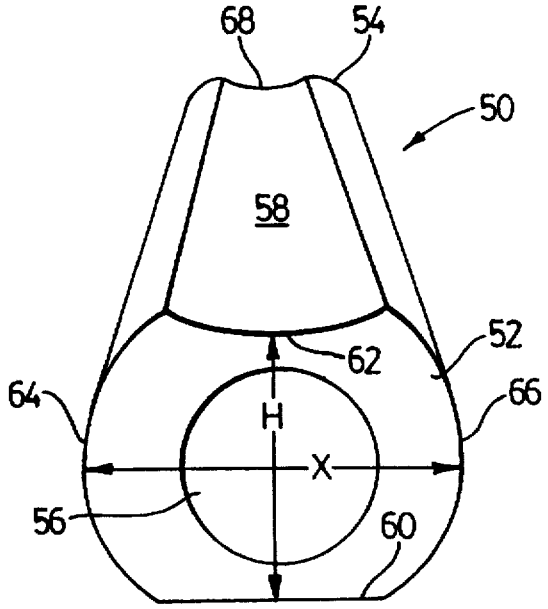
FIG. 7 is a perspective view showing the solid core of the supporting device of FIG. 1, this view showing the top of the core and the wide end thereof.

The preferred elongate body 12 includes an inner core made of substantially rigid, heat insulating material. This substantially rigid core 50 is illustrated in FIG. 7 and it has a wide first end 52 and a narrower second end 54. A preferred material for this core is polystyrene foam which is a lightweight material. The preferred core is hollow and forms an elongate interior cavity 56 sized to accommodate a standard nursing bottle therein. Also, the preferred core has a shallow trough or recess 58 extending lengthwise along its top and sized to accommodate the bottom of a person's forearm. Preferably, the core has a flat bottom surface 60 that is spaced from a top surface 62 of the core. The sides 64 and 66 are rounded so that they will fit comfortably against one's body.

In a preferred version of the device 10, the core 50 measures 5 inches across at its wide first end 52, the distance X indicated in FIG. 7. The height H of the core at first end 52 measures 3⅞ inches approximately. The corresponding width of the core at narrow end 54 is 2½ inches and the corresponding height measured downwardly from middle point 68 is 2 inches. This preferred core has a length measured from first end 52 to second end 54 of 10½ inches. The cylindrical cavity 56 in the core can have a preferred diameter of 2⅝ inches and a depth in the longitudinal direction of 4½ inches.

The cavity 56 is an advantageous feature of the supporting device 10 as it can be used to store and to keep cool and fresh a four ounce nursing bottle. Up to the present time, insulated bottle bags have been used to hold a number, for example 6, of baby bottles and these can keep a number of bottles cool for several hours. They can be used to transport the baby's feedings for a whole day (or longer) to a babysitter's home for example. However, for an outing of several hours, six large size baby bottles are not required and these known bags are larger than what is needed to accommodate a single 4 ounce bottle. It is also possible to put a baby bottle in a plastic bag with some ice cubes or a cold pack, but the use of ice cubes is messy and the use of a cold pack requires one to remember to put the cold pack in the freezer ahead of time.

With the preferred form of supporting device described herein, the insulating core of the device is able to keep a small baby bottle cool and fresh for up to four hours in normal room temperature conditions.

Figure 5:
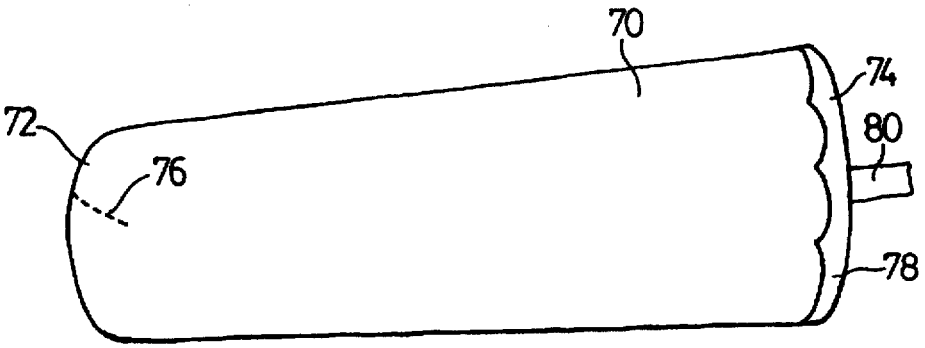
FIG. 5 is a side elevation of the supporting device with its outer cloth sleeve removed and showing an inner fabric cover.
Figure 6:
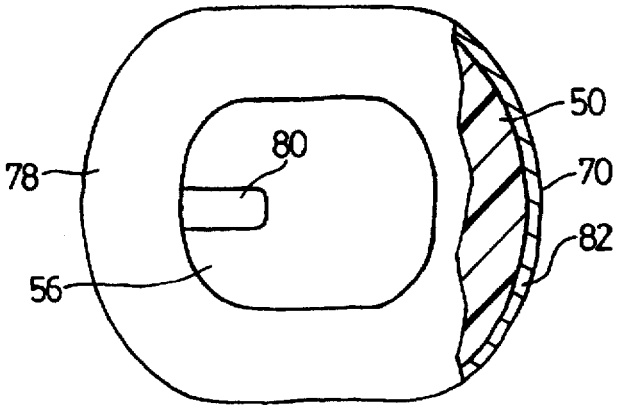
FIG. 6 is a right end view of the supporting device shown in FIG. 5, with a portion shown in cross-section to illustrate the fabric layers surrounding the solid core.

FIGS. 5 and 6 illustrated a preferred inner covering for the solid core of the device 10. In particular, between the washable cover sleeve and the solid core is a permanent, waterproof nylon cover 70 which can also be in the form of a sleeve that is closed at both ends 72 and 74. After the flannel outer cover has been removed, the nylon cover 70 can be wiped clean, if necessary, with soapy water and air dried. At the end 72, the cover 70 simply forms a rounded end that is closed by stitching 76. However, at the wider end 74 the cover 70 has an end section 78 stitched thereto. This end section forms an inner sleeve that extends into the bottle cavity 56 and covers the sidewalls and bottom thereof. This extension of the cover can be pulled out for cleaning or for removal of the bottle by means of a tab 80 stitched thereto.

In order to make the supporting device 10 more comfortable in use, a layer or layers of padding material is arranged between the nylon cover 70 and the solid core. In one preferred embodiment of the device, the padding material 82 comprises two layers of polyester quilt batting that extends completely around the sides of the solid core 50. Preferably a third layer is placed over the top of the core for extra comfort where the arm rests. This batting can be secured in place by a non-toxic adhesive or by suitable tape. Instead of using separate layers of batting and the aforementioned nylon cover 70, these can be replaced by a quilted nylon fabric material which is available and which will provide both padding for the support and a durable nylon cover. However, with the use of this alternative, some extra padding may still be required on the top of the support. Preferably, either form of nylon cover should be made of a flame retardant material.

Figure 8:
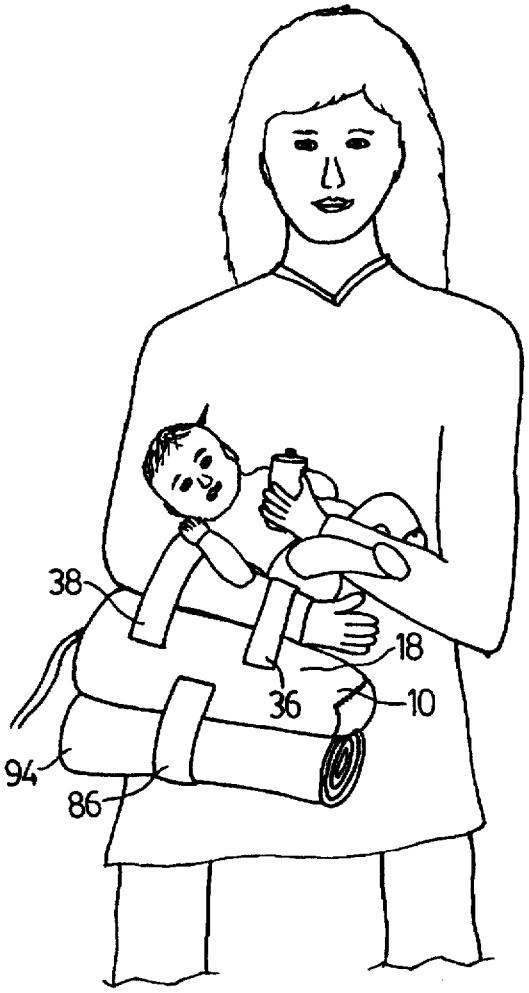
FIG. 8 is a perspective view illustrating the use of the present device by a caregiver supporting a baby.

The supporting device 10 can also be provided with means for adjusting the overall height of the device in a direction generally perpendicular to its top and bottom surfaces. In the illustrated preferred embodiment, the suggesting means comprises two possible straps 84 and 86 but a single strap or more than two straps can also be used for this purpose. Each of straps 84 and 86 is connected at one end to the sleeve 18. The straps are provided with multiple hook and loop fastener means 88 for securing the straps to one another. As shown in FIG. 1, the strap 84 can be provided with a strip of loop material 90 on its outer surface, which material extends substantially to the free end of the strap. The other strap 86 is provided with a shorter strip of hook material 92 stitched to its inner surface. It will be understood that this hook and loop material is available under the trade mark Velcro. The straps can be used to secure a pad of soft, flexible material to the bottom surface of elongate body 12 as illustrated in FIG. 8. One readily available pad that is available to mothers and other caregivers is a folded up receiving blanket 94. This folded blanket can be used to make the overall supporting device 10 one or two inches higher. As shown, the folded blanket is placed lengthwise along the bottom of the device 10 and straps 84 and 86 are extended around a central portion of the blanket and secured to one another to hold the blanket in place. The amount of the height adjustment will depend on how the receiving blanket is folded. If the straps 84 and 86 are not required for height adjustment, they will lay flat against the bottom of the device 10. These straps can also be used to hold a diaper or extra sleeper which might be required, for example, for a short outing.

Figure 4:
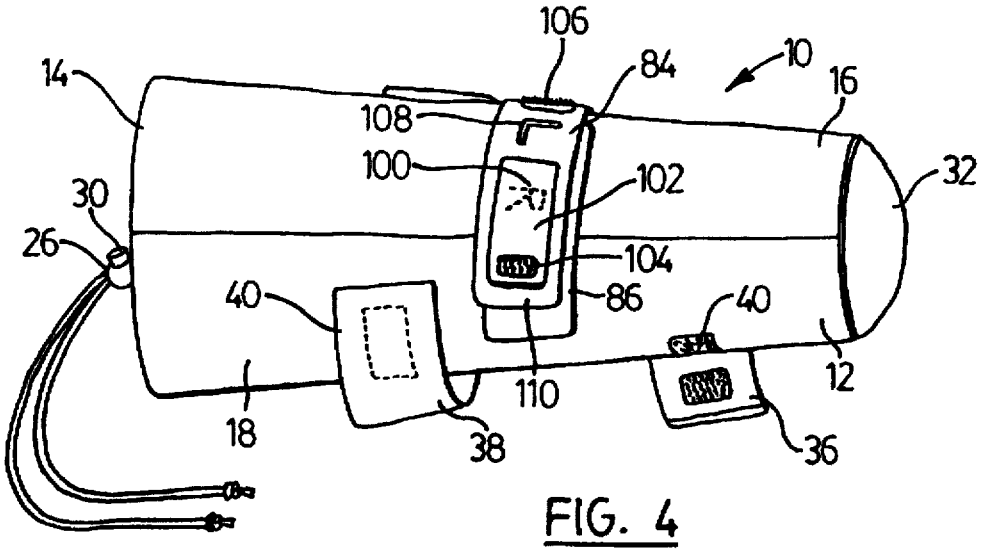
FIG. 4 is a bottom view of the supporting device of FIG. 1.

An optional feature that can be affixed to the exterior of the device 10 is a left/right indicator 100 that enables a nursing mother to remember which side to start nursing on next. The position of the indicator is alternated between the left or a right position with each feeding. The indicator can be arranged on the strap 84 as shown in FIG. 4 and it comprises a small flap 102 having a loop fastener strip 104 on one side of its free end. This permits the end of the strap 102 to be secured in a first position (not shown) using a hook fastener strip 106 stitched to the outer surface of strap 84. In this position, the strap 102 covers an embroidered letter "L" shown at 108. In this position, an embroidered letter "R" is exposed, indicating to the mother that she should nurse from the right side next. It will be understood that the strap 102 can also be moved to a second position wherein the embroidered letter "L" is exposed, this position being shown in FIG. 4. The strap 102 can be secured in this position by means of a strip of loop pile (not shown) stitched to the free end of strap 102 directly opposite the strip 104. This loop strip is secured to another hook fastener strip stitched to the strap 84 near its free end 110.

It will be appreciated that the preferred supporting device 10 described herein can provide full and proper support for a caregiver's arm and enables a baby to be cradled securely. Use of the present device will reduce strain and fatigue on the caregiver's arm, shoulder and neck. It will be appreciated that a new born baby can feed as often as every two hours, and for half an hour or longer, so the strain on one's arm can be considerable if nothing is used for support.

As indicated, the preferred supporting device 10 can be adjusted to fit any size arm and, with its preferred adjustment feature, it can be adjusted up to two inches in height to accommodate nursing mothers who may be longer in the torso than average. It can be made very light in weight and, in one preferred embodiment, weighs only 5 ounces (10 ounces with a full bottle inside). It is very portable and can be used on any kind of seat, chair, couch, or the floor, provided there is approximately 4 to 6 inches of clearance from the outside edge of the elbow, when flush against the torso, to allow the arm with the support to extend out into a cradling position.

It will be appreciated that the internal cavity 56 can be used for purposes other than storing a baby bottle. For example, it can be used to store small toys and rattles, a sun hat or small bottle of sun screen, or can of pop or juice for the caregiver.

It will also be appreciated that the present support device 10 can be used for other purposes than assisting a caregiver to support a baby. For example, it can be used as a therapeutic armrest for a person suffering from such ailments such as arthritis or a sprained wrist. Many standard wheelchairs have armrests that come only halfway from the back of the chair and these wheelchairs may have enough clearance to permit use of the device 10 of the invention. In this case, the outer cover or sleeve could be made of another more appropriate material such as vinyl.

It will be appreciated by one skilled in the art that various modifications and changes could be made to the described supporting device without departing from the spirit and scope of this invention. Accordingly, all such modifications and changes as fall within the scope of the appended claims are intended to be part of this invention.

I hereby claim:

1. A forearm supporting device for use by a person comprising:

an inner, elongate body made of substantially rigid material and having a top surface formed by said substantially rigid material, a bottom surface spaced from said top surface, and first and second ends, said body tapering in height from said first to said second end so that the overall height of said device becomes less between said first and second ends;

an outer sleeve of flexible sheet material extending completely around and along said elongate body, said sleeve covering said top and bottom surfaces of said elongate body and located adjacent thereto; and means for detachably connecting said device to a person's forearm.

2. A forearm supporting device according to claim 1 wherein said sleeve substantially encloses said elongate body and is made of a soft, washable fabric.

3. A forearm supporting device according to claim 1 wherein said connecting means comprises at least one connecting strap connected at one end to said sleeve.

4. A forearm supporting device according to claim 2 wherein said elongate body is made of polystyrene foam.

5. A forearm supporting device according to claim 1 wherein said elongate body is hollow and forms an elongate, interior cavity that is open at one end thereof.

6. A forearm supporting device according to claim 1 wherein said body is made of substantially rigid, insulating foam, is hollow, and forms an elongate interior cavity sized to accommodate a nursing bottle therein.

7. A forearm supporting device according to claim 2 including means for adjusting the overall height of said device.

8. A forearm supporting device according to claim 1 including strap means for adjusting the overall height of said device, said strap means being connected at one end thereof to said fabric sleeve and being secured in use about a separate height adjusting member by interengaging multiple hook and loop fastening means.

9. A forearm supporting device according to claim 2 wherein said elongate body is formed with a shallow trough extending lengthwise along a top of said body.

10. A forearm supporting device according to claim 2 including at least one layer of padding material interposed between said elongate body and said outer sleeve.

11. A forearm supporting device for use by a person comprising:

an elongate body having first and second ends and tapering from said first to said second end so that the overall height of said device becomes less between said first and second ends, said body being made primarily of heat insulating material and having an elongate cavity formed centrally therein and defined by a longitudinally extending, interior, annular sidewall, said cavity being sized to accommodate a nursing bottle and surrounded circumferentially by said insulating material;

an access opening in said first end of said body to permit said bottle to be inserted in said cavity; and means for detachably connecting said device to a person's forearm.

12. A forearm supporting device for use by a person comprising:

an elongate body having first and second ends and tapering from said first to said second end so that the overall height of said device becomes less between said first and second ends, said elongate body including an inner core made of heat insulating plastic material and an outer fabric sleeve extending around and along said inner core and having a cavity formed centrally therein, said cavity being sized to accommodate a nursing bottle and surrounded by said insulating material;

an access opening in said first end of said body to permit said bottle to be inserted in said cavity; and means for detachably connecting said device to a person's forearm.

13. A forearm supporting device according to claim 12 wherein said connecting means comprises at least one strap made of fabric, said at least one strap being connected at one end to said elongate body, and multiple hook and loop fastener means arranged at the other end of said at least one strap and on an exterior surface of said elongate body.

14. A forearm supporting device according to claim 12 wherein said inner core is made of polystyrene foam.

15. A forearm supporting device according to claim 12 including means for strapping a height adjusting member to said elongate body.

16. A forearm supporting device for use by a person comprising:

an elongate body having first and second ends, a top surface, and a bottom surface, a core of supporting material, and an outer sleeve of flexible sheet material covering said core, means for detachably connecting said body to a person's forearm, and means for adjusting the overall height of said device in a direction generally perpendicular to said top and bottom surfaces.

17. A forearm supporting device according to claim 16 wherein said adjusting means is at least one flexible strap connected at one end to said elongate body.

18. A forearm supporting device according to claim 17 wherein said adjusting means includes multiple hook and loop fastener means, part of which is arranged on the other end of said at least one flexible strap.

19. A forearm supporting device according to claim 16 wherein said adjusting means includes a pad of soft, flexible material attached to said bottom surface of said elongate body.

20. A forearm supporting device according to claim 17 wherein said core is substantially rigid, said outer sleeve is removable from said core and washable, and said connecting means includes at least one flexible strap connected at one end thereof to said elongate body.

* * * * *